US010933421B2

(12) United States Patent
Friedman

(10) Patent No.: US 10,933,421 B2
(45) Date of Patent: Mar. 2, 2021

(54) WELL STRIP EXTRACTOR PRESS AND METHOD

(71) Applicant: Union Scientific, LLC, Boca Raton, FL (US)

(72) Inventor: Mitchell Friedman, Boca Raton, FL (US)

(73) Assignee: Union Scientific, LLC, Boca Raton, FL (US)

( * ) Notice: Subject to any disclaimer, the term of this patent is extended or adjusted under 35 U.S.C. 154(b) by 0 days.

(21) Appl. No.: 16/869,721

(22) Filed: May 8, 2020

(65) Prior Publication Data

US 2020/0376495 A1 Dec. 3, 2020

Related U.S. Application Data

(60) Provisional application No. 62/855,430, filed on May 31, 2019.

(51) Int. Cl.
*B01L 9/00* (2006.01)
*B01L 3/00* (2006.01)

(52) U.S. Cl.
CPC ..... *B01L 9/52* (2013.01); *B01L 3/50853* (2013.01); *B01L 3/50855* (2013.01); *B01L 9/523* (2013.01); *B01L 2200/021* (2013.01); *B01L 2200/04* (2013.01); *B01L 2300/041* (2013.01); *B01L 2300/0858* (2013.01); *B01L 2300/168* (2013.01)

(58) Field of Classification Search
CPC ..... B01L 2200/025; B01L 2300/0609; B01L 2300/0829
USPC ..... 422/562, 561
See application file for complete search history.

(56) References Cited

U.S. PATENT DOCUMENTS 4,154,795 A 5/1979 Thorne
4,895,706 A 1/1990 Root et al.
4,948,564 A 8/1990 Root et al.
(Continued)

FOREIGN PATENT DOCUMENTS

EP 0339769 2/1989

*Primary Examiner* — Natalia Levkovich
(74) *Attorney, Agent, or Firm* — Whiteford, Taylor & Preston, LLP; Gregory M. Stone

(57) ABSTRACT

Disclosed herein are a device and method for the easy removal of selected individual wells, selected groups/strips of wells, or all strips of wells quickly and safely from a well strip plate. A well strip extractor press may include a manually pivotable well strip plate carrier having an open bottom, and an adjustable well strip extractor assembly having multiple press arms positioned to engage the bottom of a well strip plate positioned in the well strip plate carrier. A user may manually position a selection of press arms to align with those well strips that the user wishes to remove from the well strip plate. The user may lower the plate carrier into a frame assembly that pivotably mounts the press arms, causing the selected well strips that are to be dislodged from the well strip plate to engage individual extractor pins on the selected press arms, in turn causing those extractor pins to push the bottom portions of the selected well strips upward so as to at least partially dislodge from their seating within the strip well plate. Thereafter, a user may slide the strip well plate out from the plate carrier and remove the selected well strips from the well strip plate with ease.

18 Claims, 10 Drawing Sheets

(56) References Cited

U.S. PATENT DOCUMENTS

| | | | | |
|---|---|---|---|---|
| 5,084,246 | A | 1/1992 | Lyman et al. | |
| 5,110,556 | A | 5/1992 | Lyman et al. | |
| D608,013 | S | 1/2010 | Coulling et al. | |
| 2016/0214114 | A1* | 7/2016 | Tan | B01L 9/527 |

* cited by examiner

WELL STRIP EXTRACTOR PRESS AND METHOD

CROSS REFERENCE TO RELATED APPLICATIONS

This application is based upon and claims the benefit of U.S. Provisional Application No. 62/855,430 titled "Well Strip Extractor Press," filed with the United States Patent & Trademark Office on May 31, 2019, the specification of which is incorporated herein by reference in its entirety.

FIELD OF THE INVENTION

The present invention relates to equipment and methods for handling microplates, and more particularly to a manual press configured to selectively dislodge individually selected well strips from an assembled well strip plate, and a method for dislodging individually selected well strips from an assembled well strip plate using a manual press.

BACKGROUND OF THE INVENTION

Multiple cavity plastic containers have been used as reagent and reaction containers in the biotechnology sciences for over 30 years. Such containers are often referred to as "microplates." They are made with a basic outline shape which originally contained anywhere between 6 and 96 individual cavities, or wells, as they are now commonly referred to. This permits chemical and biological reactions to occur using less reagents and smaller samples as well as being in a format lending itself to rapidly examining test results in automated laboratory equipment. At present, the number of individual cavities in these microplates have increased to 384 and even 1,536. The most popular versions are those containing 96 openings, or wells, in various heights.

Costs associated with the evaluation of test results are important, and one method of reducing the cost of testing, for example, one patient's sera, that might require only several of the 96 wells, was introduced by Corning Corporation some years ago. With reference to FIGS. 1-3, that system includes 12 individual molded plastic well strips 10, each composed of 8 separate wells, that may be removably positioned in an empty well strip plate frame 12 having identical measurements to a one-piece 96 well plate. FIG. 3 shows a fully assembled well strip plate 14 with well strips 10 seated in well strip plate frame 12.

After a reaction is completed within a group of 8 or fewer wells within one of the 12 strips, it may be desirable to remove that individual strip to examine the contents of each well on a different laboratory device. Because each strip must be held within the full 96 well frame for initial processing, the strips must be held securely in the frame. Removal of all or some of the individual strips after processing can be difficult or unwieldly.

Thus, there remains a need in the art for devices and methods that enable the easy removal of individual strips from a well strip plate.

SUMMARY OF THE INVENTION

Disclosed herein are a device and method that address one or more disadvantages of the prior art by enabling the easy removal of selected individual wells, selected groups/strips of wells, or all strips of wells quickly and safely from a well strip plate for further analysis. In accordance with an exemplary embodiment, a well strip extractor press includes a manually pivotable well strip plate carrier having an open bottom, and an adjustable well strip extractor assembly having multiple press arms positioned to engage the bottom of a well strip plate positioned in the well strip plate carrier. A user may manually position a selection of press arms to align with those well strips that the user wishes to remove from the well strip plate. In use, the user may lower the plate carrier into a frame assembly that pivotably mounts the press arms, causing the selected well strips that are to be dislodged from the well strip plate to engage individual extractor pins on the selected press arms, in turn causing those extractor pins to push the bottom portions of the selected well strips upward so as to at least partially dislodge from their seating within the strip well plate. Thereafter, a user may slide the strip well plate out from the plate carrier and remove the selected well strips from the well strip plate with ease.

In accordance with certain aspects of an embodiment, a well strip extractor press is provided comprising: a frame assembly; an adjustable well strip extractor assembly in the frame assembly and having a plurality of extractor pins; and a plate carrier pivotably attached to the frame assembly and configured to removably receive a well strip plate; wherein the plate carrier is configured to bring selected removable well strips in a well strip plate positioned in the plate carrier into contact with a selected plurality of the extractor pins so as to at least partially dislodge the selected removable well strips from the well strip plate.

In accordance with further aspects of an embodiment, a method of dislodging individually selected well strips from an assembled well strip plate is provided, comprising the steps of: providing a well strip extractor press comprising: a frame assembly; an adjustable well strip extractor assembly in the frame assembly and having a plurality of extractor pins; and a plate carrier pivotably attached to the frame assembly and configured to removably receive a well strip plate; wherein the plate carrier is configured to bring selected removable well strips in a well strip plate positioned in the plate carrier into contact with a selected plurality of the extractor pins so as to at least partially dislodge the selected removable well strips from the well strip plate; positioning a well strip plate having a plurality of removable well strips in the plate carrier; adjusting the well strip extractor to position a selected plurality of the extractor pins to engage one or more selected well strips; and pivoting the plate carrier into the frame assembly to cause the selected plurality of extractor pins to at least partially disengage the one or more selected well strips from the well strip plate.

BRIEF DESCRIPTION OF THE DRAWINGS

The numerous advantages of the present invention may be better understood by those skilled in the art by reference to the accompanying drawings in which:

FIG. 11(*c*) is a cross sectional view of the press arm along section line A-A of FIG. 11(*a*).

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced items.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Figure 1:
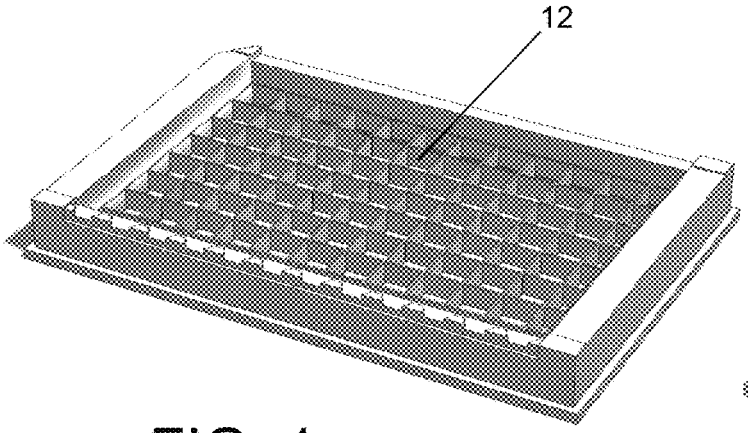
FIG. 1 PRIOR ART
FIG. 1 is a perspective view of a prior art well strip plate.
Figure 2:
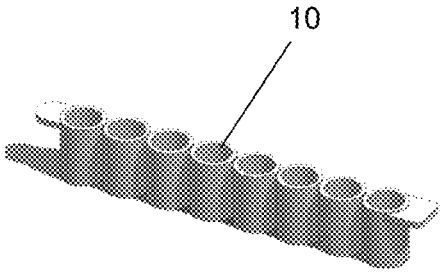
FIG. 2 PRIOR ART
FIG. 2 is a perspective view of a prior art well strip for use in the well strip plate of FIG.
Figure 3:
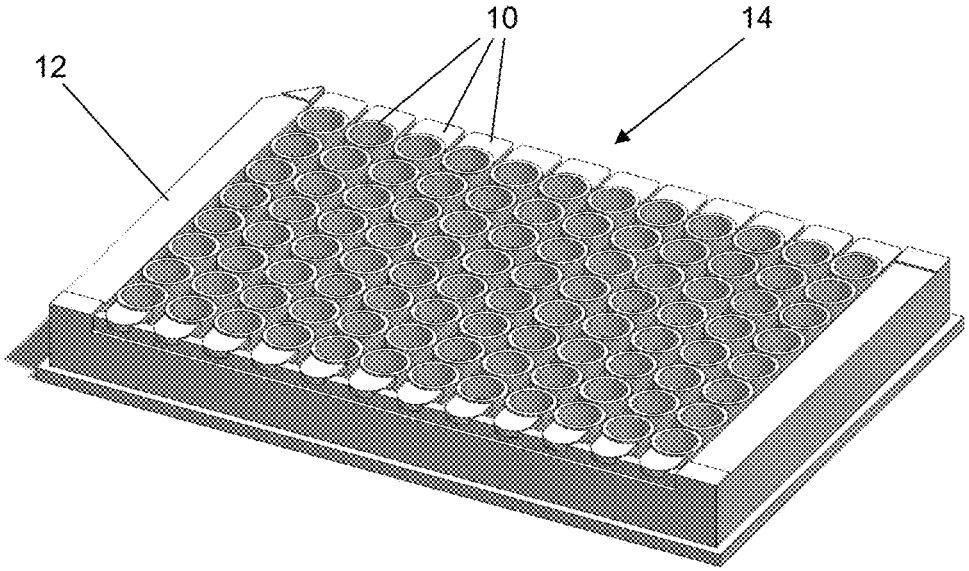
FIG. 3 PRIOR ART
FIG. 3 is a perspective view of the well strip plate of FIG. 1 with a number of well strips installed therein.
Figure 4:
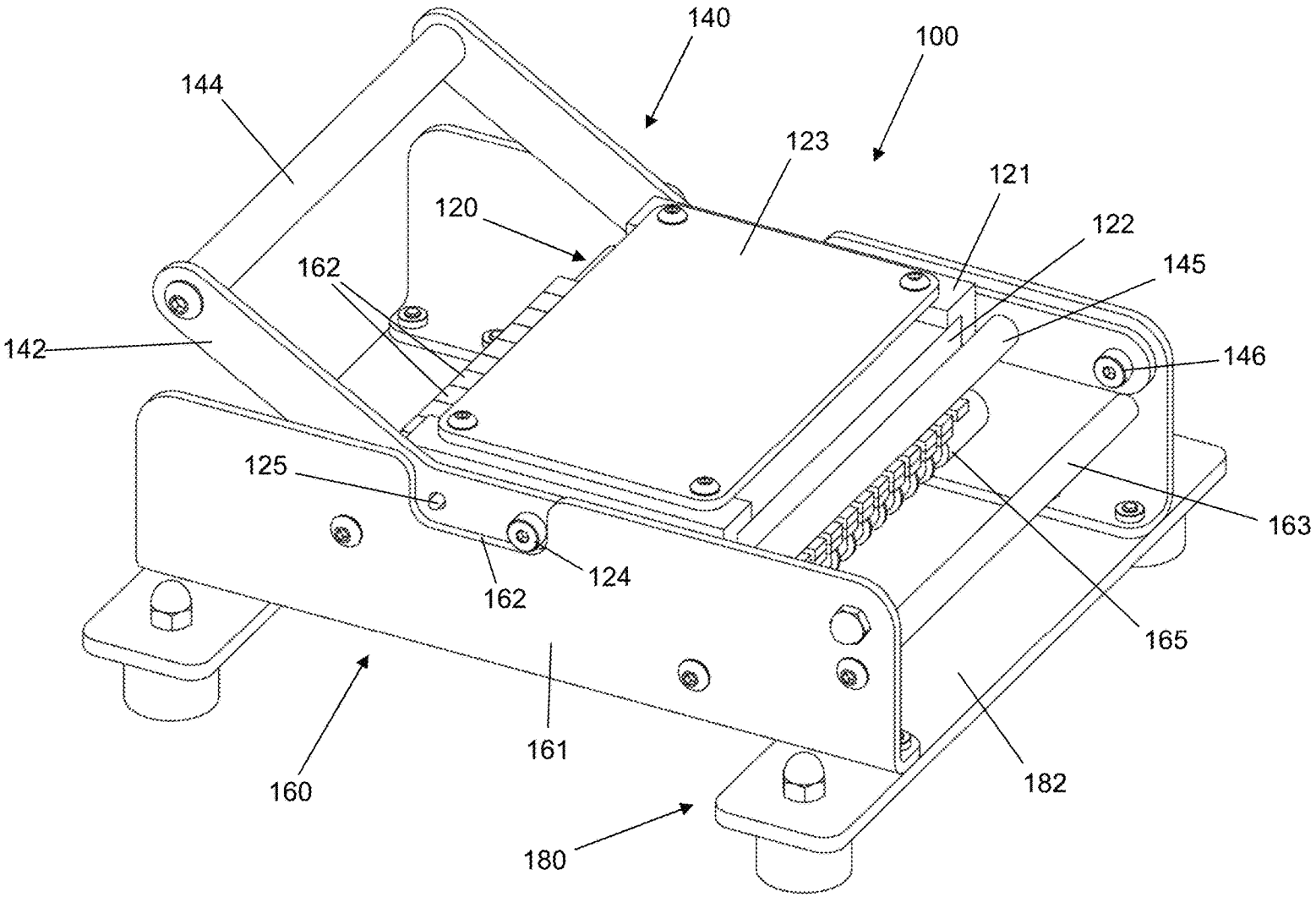
FIG. 4 is a perspective view of a well strip extractor press 100 in accordance with certain aspects of an embodiment of the invention.
Figure 5:
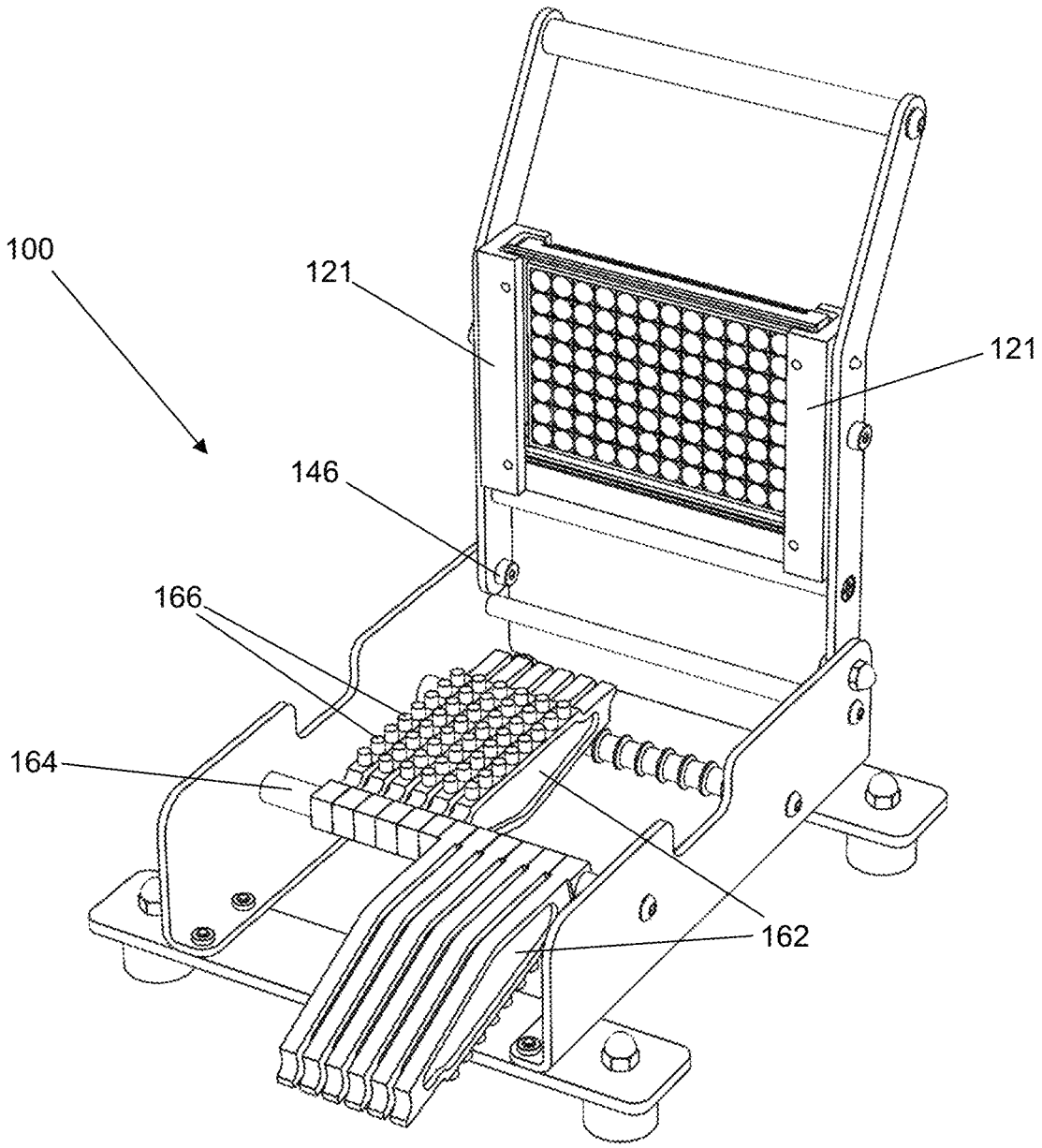
FIG. 5 is a perspective view of the well strip extractor press 100 of FIG. 4 with the plate carrier in a raised position.

In accordance with certain aspects of an embodiment of the invention and with reference to FIG. 4 and FIG. 5, a well strip extractor press 100 is provided having a plate carrier 120 fixed to a lever assembly 140, which level assembly 140 is pivotably mounted to a frame assembly 160 mounted to a base assembly 180. Plate carrier 120 is configured to removably receive and hold an assembled well strip plate 14 so that the top of the well strip plate 14 faces the top of the plate carrier 120, and the bottom of the well strip plate 14 faces the bottom of the plate carrier 120. An adjustable well strip extractor assembly 161 includes a number of press arms 162 that are pivotably mounted to a press arm mounting bar 164 in frame assembly 160, each of which press arms 162 include a plurality of extractor pins 166. Each press arm 162 may be pivoted into the engaging position of the left-most press arms of FIG. 5, in which the press arm 162 sits directly below plate carrier 120 and in alignment with a single well strip 10, or alternatively into the disengaging position of the right-most press arms of FIG. 5, in which the press arm 162 is moved out of the path of plate carrier 120. Likewise, each extractor pin 166 of each press arm 162 is positioned to align with the bottom of a single well in a single well strip 10 when the press arm 162 is in the engaging position below plate carrier 120. Thus, pivoting lever assembly 140 downward into frame assembly 160 causes the extractor pins 166 on press arms 162 positioned in the engaging position to contact the bottom surface of the wells in the aligned well strip 10, in turn pushing the aligned well strip 10 upward in well strip plate 12. This in turn loosens the otherwise tight connection between that well strip 10 and its respective slot in well strip plate 12, thus allowing an operator to then easily remove the desired well strips while leaving the remaining well strips in place.

Figure 6:
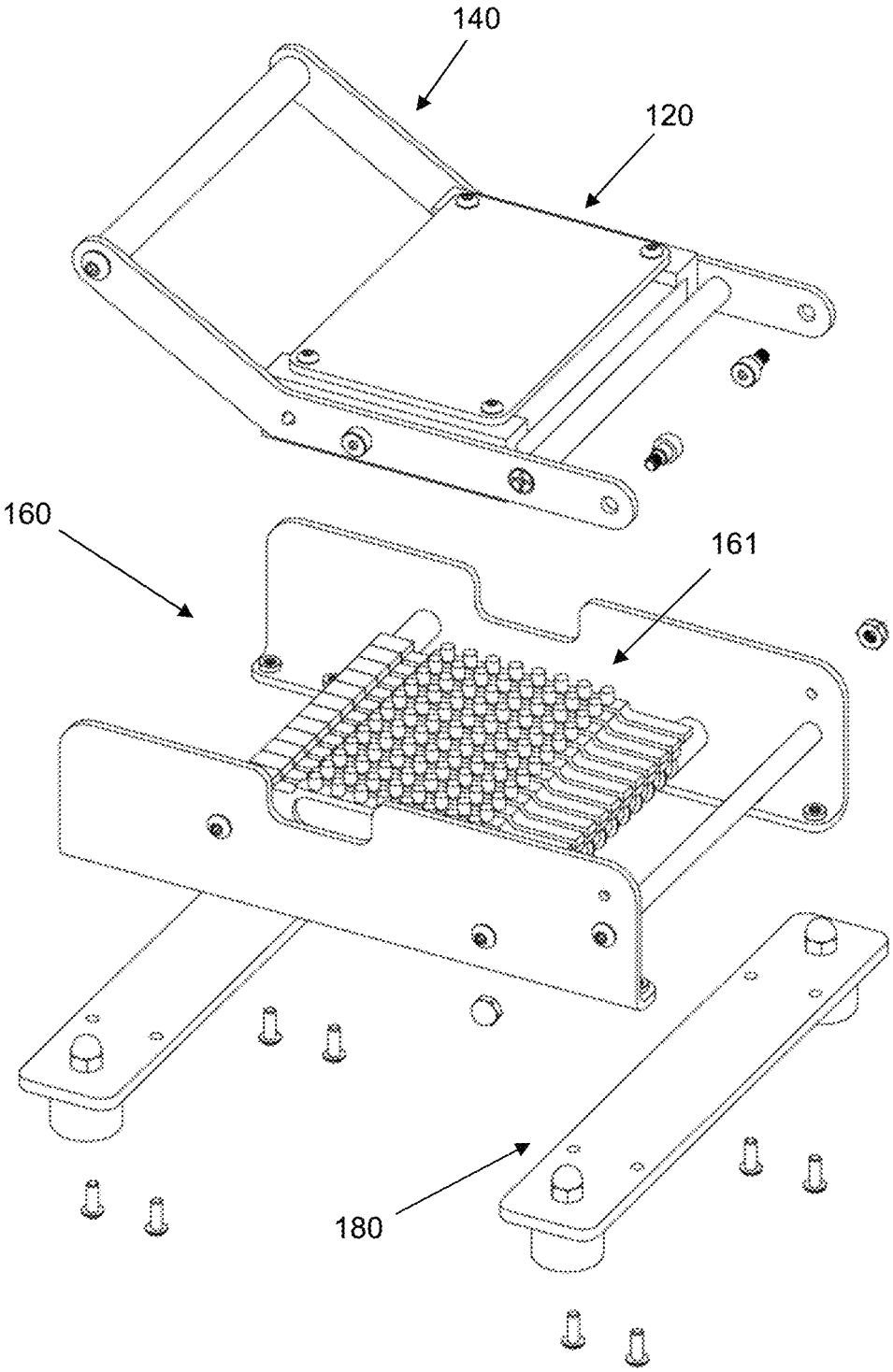
FIG. 6 is an exploded view of the well strip extractor press of FIGS. 4 and 5.

FIG. 6 provides an exploded view of well strip extractor press 100 showing the major subassemblies of plate carrier 120 in lever assembly 140, frame assembly 160, and base assembly 180, each of which will now be further detailed.

Figure 7:
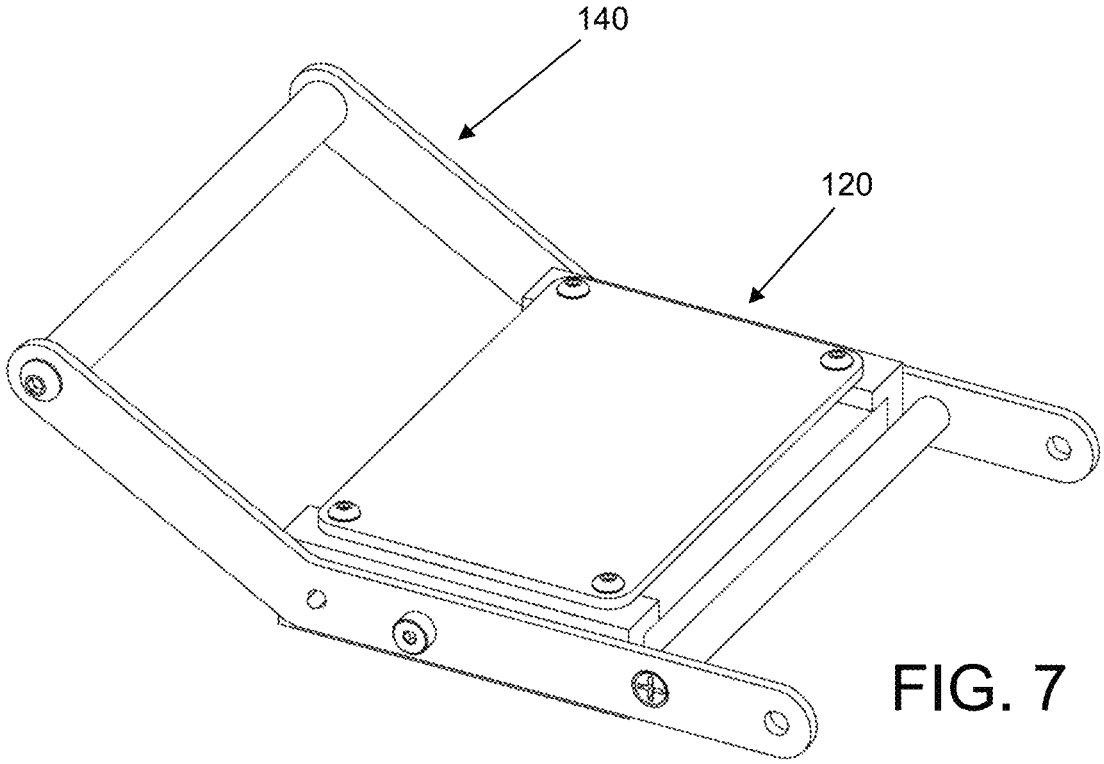
FIG. 7 is a perspective view of a plate carrier and lever assembly for use with the well strip extractor press of FIGS. 4 and 5.
Figure 8:
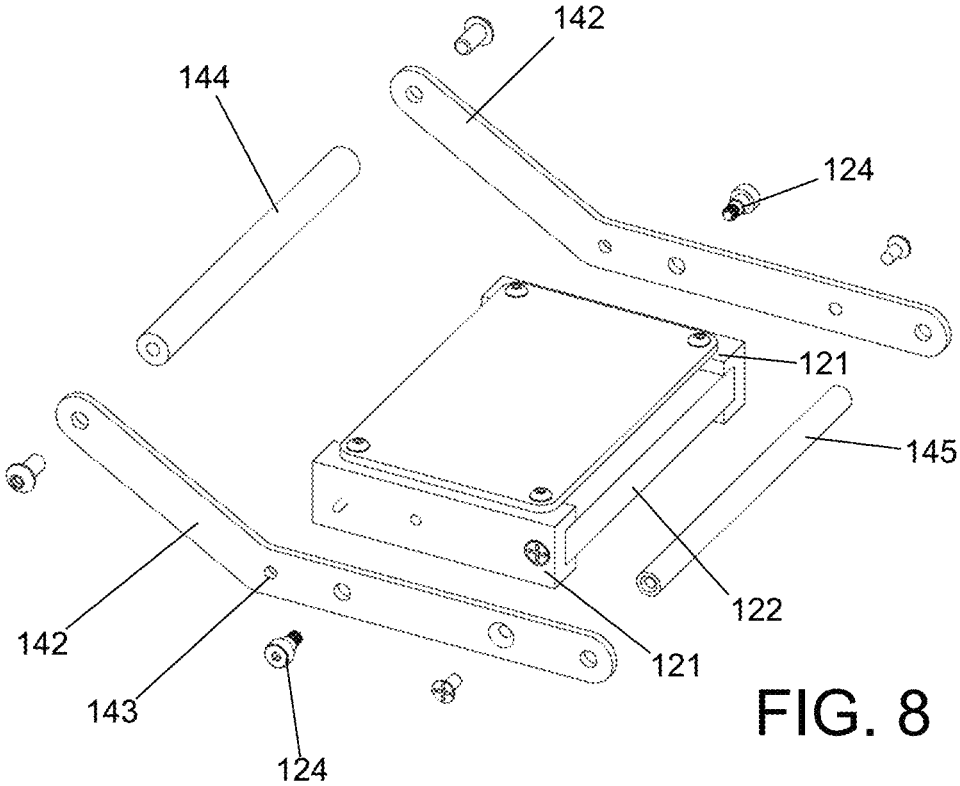
FIG. 8 is an exploded view of the plate carrier and lever assembly of FIG. 7.

FIG. 7 shows plate carrier 120 in lever assembly 140, and FIG. 8 shows an exploded view of the same. Plate carrier 120 is mounted inside of lever assembly 140, so that it moves in unison with lever assembly 140. Plate carrier 120 defines a sleeve with an opening into which an assembled well strip plate 14 may be inserted and from which the well strip plate 14 may be removed. Plate carrier 120 includes microplate guides 121, each having a slotted interior vertical wall configured to receive the edges of an assembled well strip plate 14. A plate carrier spacer 122 extends between microplate guides 121 at the back end of plate carrier 120, and serves as a stop for an inserted assembled well strip plate 14. A plate cover 123 is affixed to the top of microplate guides 121 to extend over the slot that receives assembled well strip plate 14. Plate cover 123 may be at least partially or fully transparent to allow an operator to observe well strip plate 14 as it engages press arms 162, while protecting the contents of each well.

Further, and with continued reference to FIG. 7 and FIG. 8, lever assembly 140 includes operating levers 142 having a support portion that is aligned with microplate guides 121, and an operating portion that is angled upward from the support portion, which operating portion ends at the forward end of each operating lever 142. An operating handle 144 extends between and is affixed to the forward ends of the operating levers 142, and is configured for gripping by an operator to pivot lever assembly 140 with respect to frame assembly 160. As best viewed in FIG. 4, the back end of the support portion of each operating lever 142 is joined to frame assembly 160 with pivot screws 146, which allow lever assembly 140 to pivot with respect to frame assembly 160 with little, though optionally adjustable, resistance. Additionally, an operating lever spacer 145 may extend between operating levers 142 just rearward of plate carrier 120 to further add to the rigidity of lever assembly 140.

As shown in FIGS. 4, 7, and 8, plate carrier 120 is mounted to lever assembly 140 with press arm spacers 124, each of which may have a threaded end that engages a microplate guide 121 of plate carrier 120, and a head at the outer end of spacer 124. The head of spacer 124 is positioned to engage a frame stop channel 162 in frame assembly 160, which serves as a stop against further downward pivoting movement of lever assembly 140 once it has reached the position necessary to allow press arms 162 to engage the assembled well strip plate 14 in plate carrier 120. Preferably, microplate guides 121 of plate carrier 120 also include pins 125 that engage an opening 143 in each operating lever 142 to aid in maintaining alignment between the support portions of each operating lever 142 and the microplate guides 121 of plate carrier 120.

Figure 9:
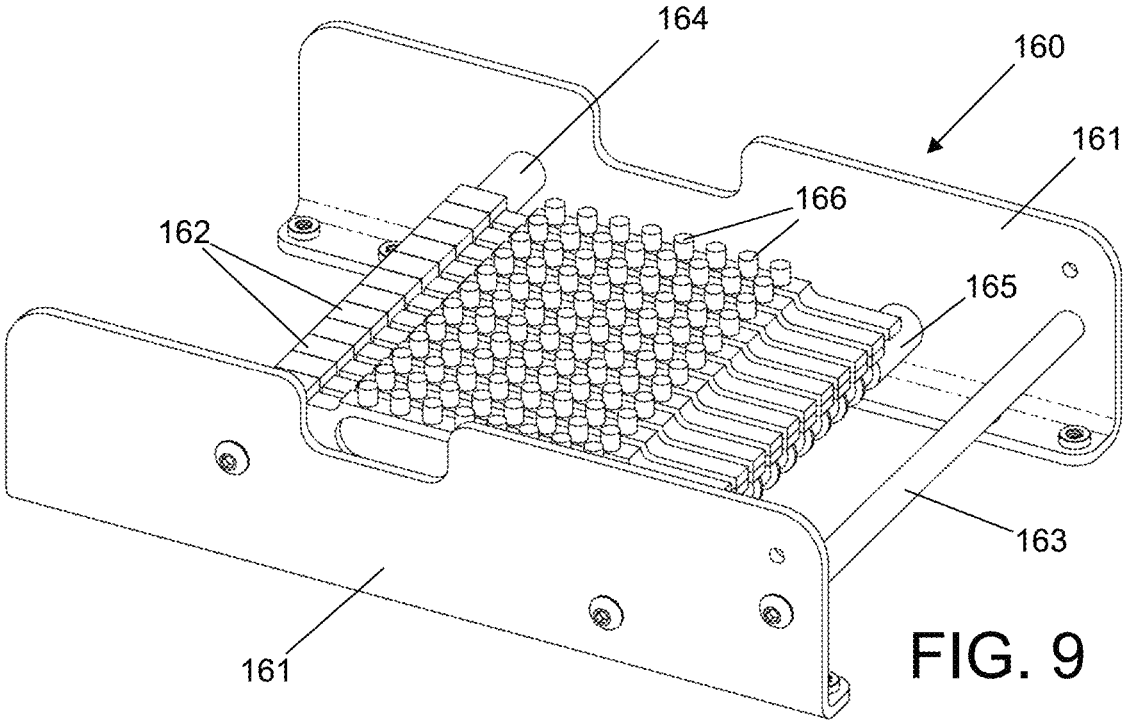
FIG. 9 is a perspective view of a frame assembly for use with the well strip extractor press of FIGS. 4 and 5.
Figure 10:
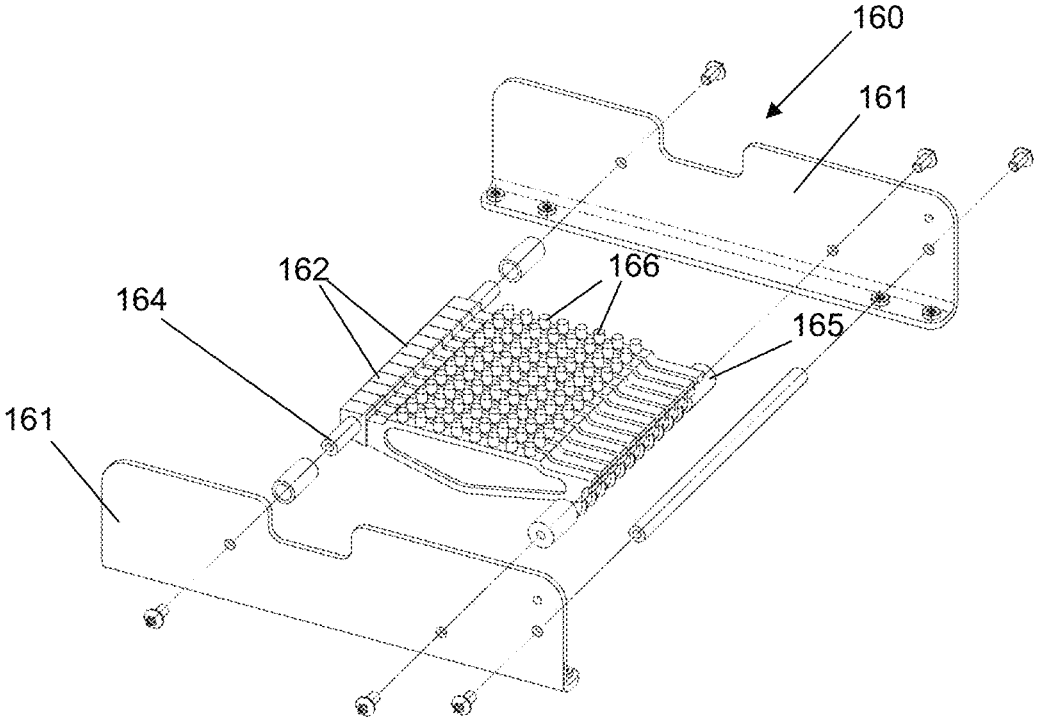
FIG. 10 is an exploded view of the frame assembly of FIG. 9.

Next, and with reference to FIG. 9 and the exploded view of FIG. 10, frame assembly 160 includes side plates 161 that are joined to one another at a back end of each side plate 161 via a side plate spacer 163, and at intermediate points via press arm mounting bar 164 and extractor spacer guide 165. More particularly, each of side plate spacer 163, press arm mounting bar 164, and extractor spacer guide 165 are affixed to opposing, internal faces of each side plate 161. Each press arm 162 is pivotably mounted to press arm mounting bar 164, such that the press arm 162 may be rotated about press arm mounting bar 164 to bring extractor pins 166 into alignment with plate carrier 120 for removal of specific well strips 10, and rotated about press arm mounting bar 164 to bring extractor pins 166 out of such alignment for those well strips 10 that are to remain in well strip plate 12. The opposite end of each press arm 162 is positioned to rest on the top of extractor spacer guide 165 as a forward stop for each such press arm 162.

Figure 11A:
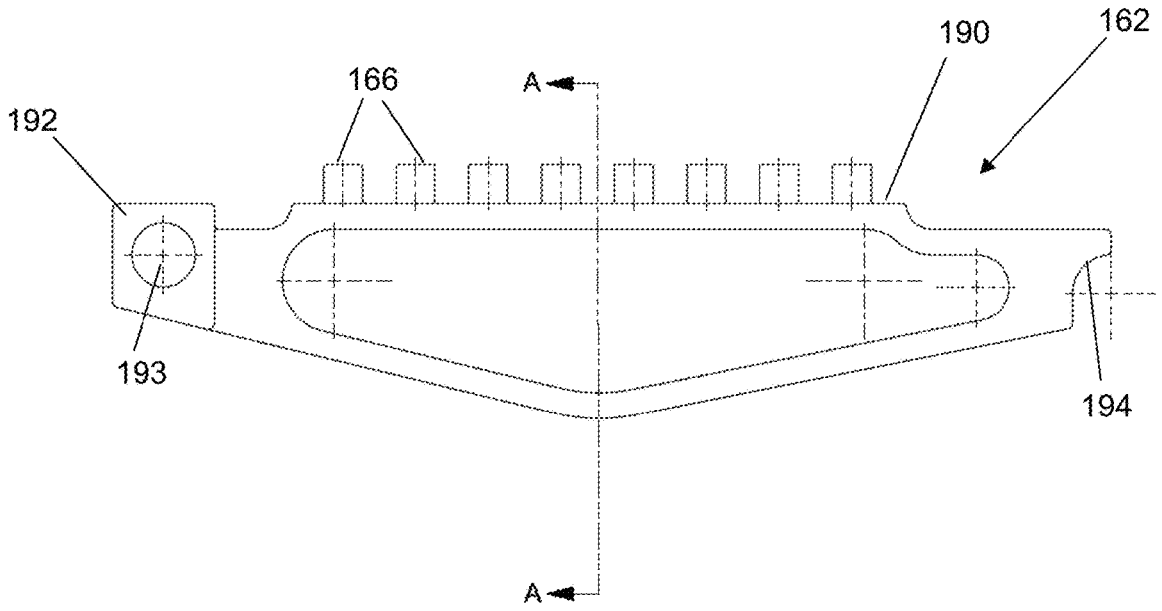
FIG. 11(*a*) is a side view and FIG. 11(*b*) is a top view of a press arm for use in the frame assembly of FIGS. 9 and 10.
Figure 11B:
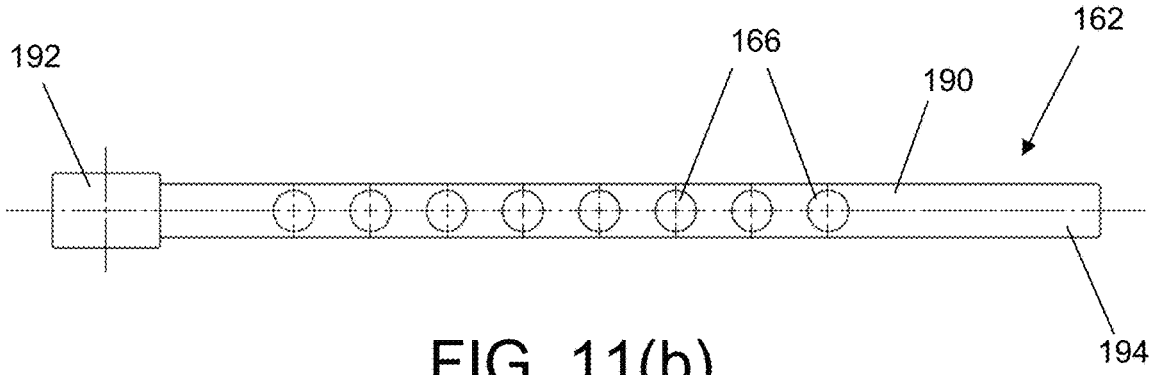
Figure 11C:
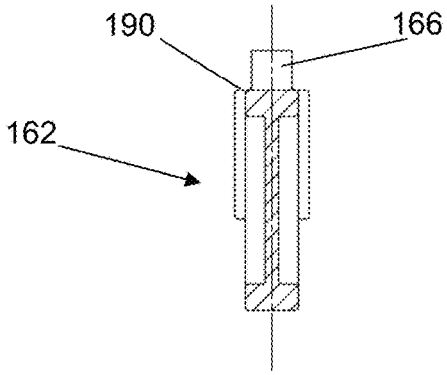
Figure 12:
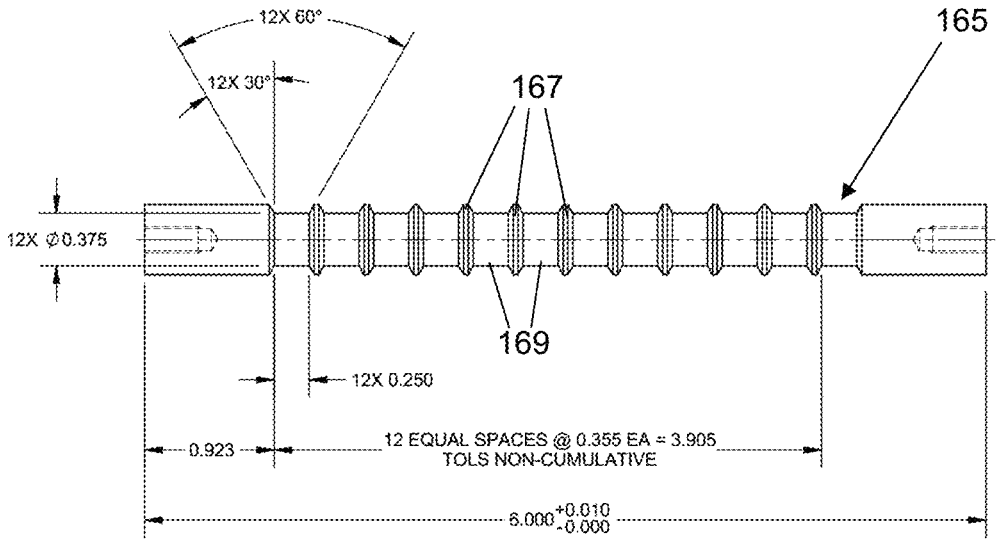
FIG. 12 is a top view of an extractor spacer guide 165 for use in the frame assembly of FIGS. 9 and 10.

With reference to FIGS. 11(*a*) and 11(*b*), each press arm 162 includes a horizontal top face 190 holding extractor pins 166, a pivot mounting block 192 having an opening 193 extending there through that is sized to receive press arm mounting bar 164 with a fit that allows pivoting of press arm 162 about press arm mounting bar 164, and a front extension arm 194 having a curved, front surface configured to closely match the contour of at least a portion of extractor spacer guide 165. As shown in FIG. 12, extractor spacer guide 165 includes ribs 167 that are spaced apart from one another so as to form gaps 169, which gaps 169 are sized to closely match the width dimension of front extension arm 194 of press arm 162, thus providing a guide for proper positioning of each press arm 162 when placed in its engagement position.

Figure 13:
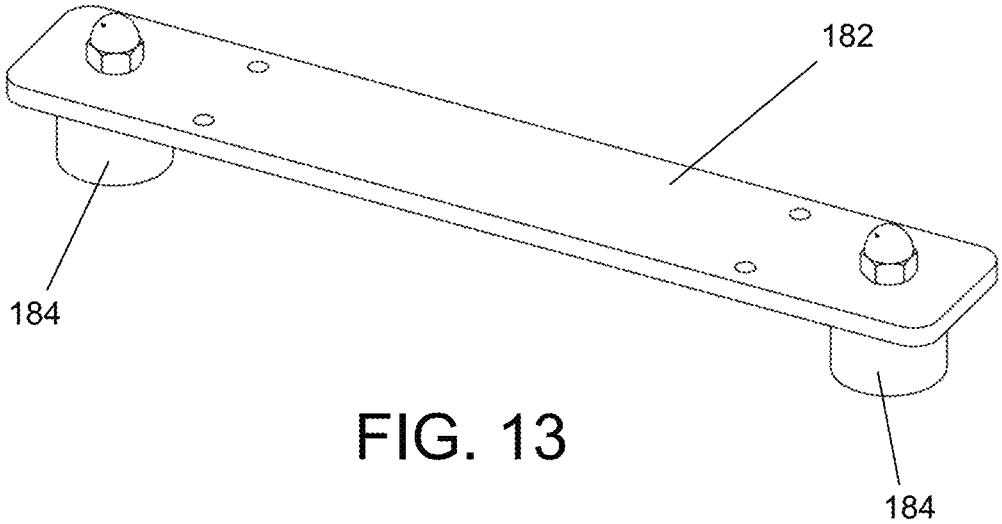
FIG. 13 is a perspective view of a bottom plate for use with the well strip extractor press of FIGS. 4 and 5.

Finally, and with reference to FIG. 4 and FIG. 13, base assembly 180 is comprised of bottom plate 182 having downwardly extending mounting feet 184. Bottom plates 182 of base assembly 180 are affixed to the bottom of each side plate 161 of frame assembly 160 using, by way of non-limiting examples, threaded connectors such as screws, bolts, or the like.

Figure 14:
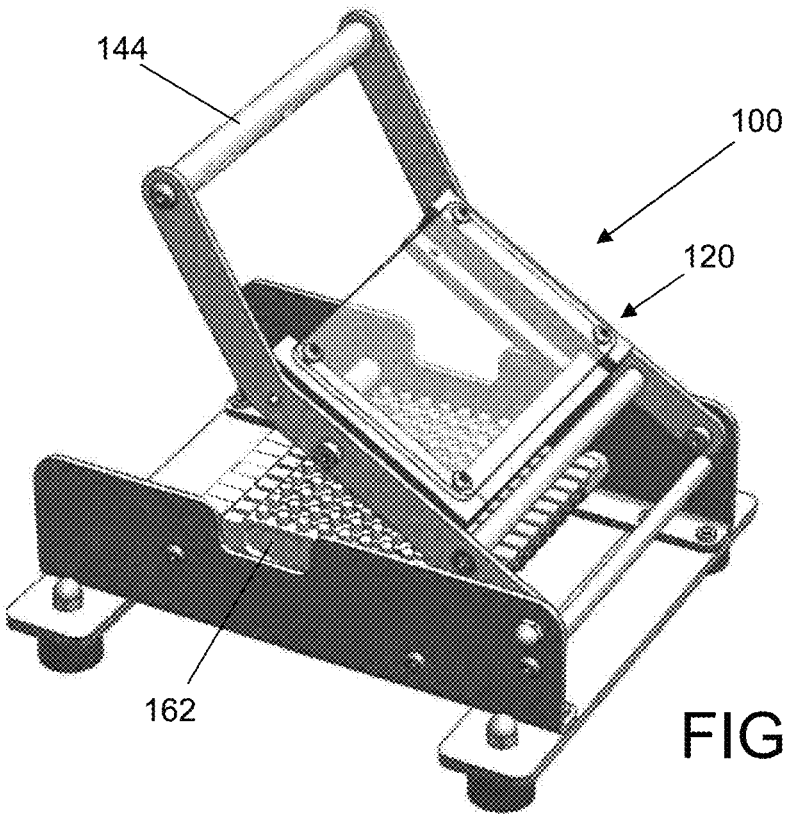
FIG. 14 is a perspective view of a well strip extractor press according to certain aspects of the invention in a raised position without a well strip plate.
Figure 15:
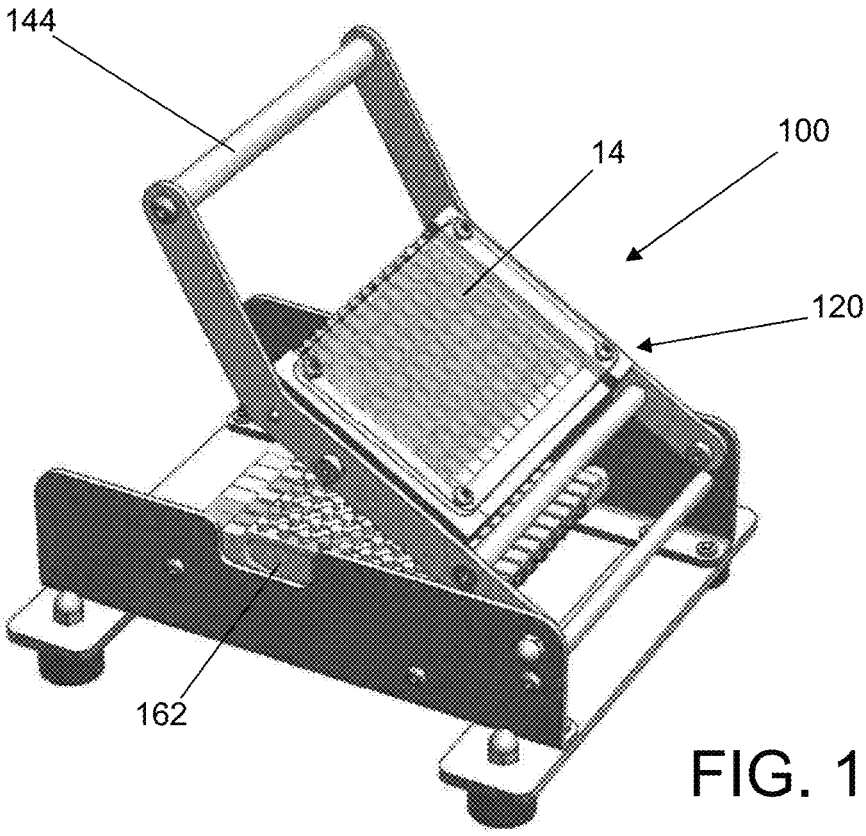
FIG. 15 is a perspective view of the well strip extractor press of FIG. 14 in a raised position with a well strip plate.
Figure 16:
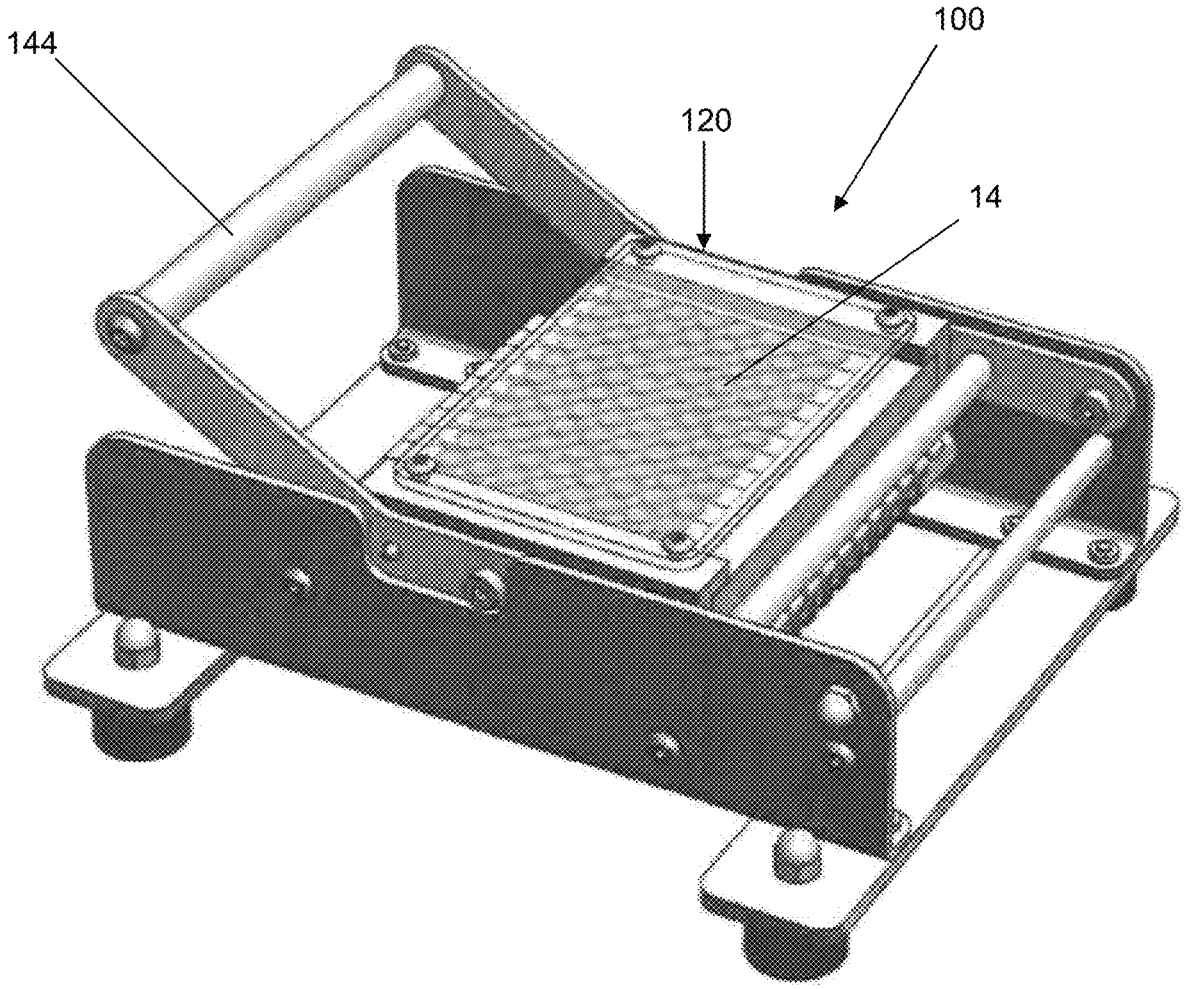
FIG. 16 is a perspective view of the well strip extractor press of FIG. 14 in a lowered position with a well strip plate.

FIGS. 14-16 show well strip extractor press 100 in use to extract well strips 10 from an assembled well strip plate 14. As shown in FIG. 14, an operator may raise plate carrier 120 by lifting operating handle 144 of lever assembly 140, and as shown in FIG. 15 insert an assembled well strip plate 14 (having well strips 10 held tightly in the frame of well strip plate 14) so that the edges of the well strip plate 14 engage the recessed walls of microplate guides 121 and until the back wall of well strip plate 14 contacts plate carrier spacer 122. The operator may then lower plate carrier 120 downward using operating handle 144 to bring the bottom of the wells of the well strips 10 in well strip plate 14 into contact with extractor pins 166, and with further downward movement cause the selected well strips 10 to be dislodged from their respective spots in the frame of well strip plate 14. With the selected well strips 10 so dislodged, the user may then raise plate carrier 120 vie operating handle 144, withdraw the well strip plate 14, and easily remove the dislodged well strips 10 for replacement, further processing, or any other function as may be deemed appropriate by the operator.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A well strip extractor press comprising:

a frame assembly;

an adjustable well strip extractor assembly in the frame assembly, said well strip extractor assembly further comprising a plurality of press arms pivotably mounted in said frame assembly and each said press arm having a plurality of extractor pins;

a plate carrier pivotably attached to the frame assembly;

a well strip plate positioned in said plate carrier and having a plurality of rows of openings, said well strip plate having a plurality of well strips removably positioned in at least some of said rows of openings;

wherein each said press arm is movable to a first position in which extractor pins on each said press arm are mated with a row of openings in said well strip plate, and further wherein each said press arm is movable to a second position in which extractor pins on each said press arm are located at a distance from said openings in said well strip plate as a result of pivoting of said press arms.

2. The well strip extractor press of claim 1, further comprising a lever assembly, wherein said plate carrier is affixed to said lever assembly, and wherein said lever assembly is pivotably mounted to the frame assembly.

3. The well strip extractor press of claim 2, said lever assembly further comprising a handle positioned at an outer end of said lever assembly.

4. The well strip extractor press of claim 1, said plate carrier further comprising a pair of opposing side walls, each said side wall having a slot therein removably receiving an edge of said well strip plate.

5. The well strip extractor press of claim 4, said plate carrier further comprising a cover extending from a top of a first one of said side walls to a top of a second one of said side walls.

6. The well strip extractor press of claim 5, wherein said cover is transparent.

7. The well strip extractor press of claim 1, wherein each said press arm is pivotable in said frame assembly independent of other of said press arms.

8. The well strip extractor press of claim 1, wherein said frame assembly further comprises:

a pair of opposing side plates; and an extractor spacer guide extending between said side plates and positioned to support an end of each said press arm.

9. The well strip extractor press of claim 8, said extractor spacer guide further comprising a plurality of spacers, wherein adjacent pairs of spacers define a press arm receiving gap sized to receive an end of a single press arm.

10. A method of dislodging individually selected well strips from an assembled well strip plate, comprising the steps of:

providing a well strip extractor press of claim 1;

adjusting said well strip extractor to position a selected plurality of said extractor pins to engage one or more selected well strips; and pivoting said plate carrier into said frame assembly to cause the selected plurality of extractor pins to disengage one or more of said well strips from said well strip plate.

11. The method of claim 10, wherein said well strip extractor press further comprises a lever assembly, wherein said plate carrier is affixed to said lever assembly, and wherein said lever assembly is pivotably mounted to the frame assembly.

12. The method of claim 11, wherein said lever assembly further comprises a handle positioned at an outer end of said lever assembly.

13. The method of claim 10, wherein said plate carrier further comprises a pair of opposing side walls, each said side wall having a slot sized to therein removably receiving an edge of said well strip plate.

14. The method of claim 13, wherein said plate carrier further comprises a cover extending from a top of a first one of said side walls to a top of a second one of said side walls.

15. The method of claim 14, wherein said cover is transparent.

16. The method of claim 10, wherein each said press arm is pivotable in said frame assembly independent of other of said press arms.

17. The method of claim 10, wherein said frame assembly further comprises:

a pair of opposing side plates; and an extractor spacer guide extending between said side plates and positioned to support an end of each said press arm.

18. The method of claim 17, wherein said extractor spacer guide further comprises a plurality of spacers, wherein adjacent pairs of spacers define a press arm receiving gap sized to receive an end of a single press arm.

* * * * *